US012203653B2

(12) United States Patent
Smith et al.

(10) Patent No.: US 12,203,653 B2
(45) Date of Patent: Jan. 21, 2025

(54) GAS BURNER FOR COOKING APPLIANCES

(71) Applicant: Tekelek Australia Pty Ltd, Gillman (AU)

(72) Inventors: Brian David Smith, Myrtle Bank (AU); Stephen John Thornton, Beaumont (AU)

(73) Assignee: Tekelek Australia Pty Ltd, Gillman (AU)

( * ) Notice: Subject to any disclaimer, the term of this patent is extended or adjusted under 35 U.S.C. 154(b) by 258 days.

(21) Appl. No.: 17/614,468

(22) PCT Filed: May 27, 2020

(86) PCT No.: PCT/AU2020/000043

§ 371 (c)(1),
(2) Date: Nov. 26, 2021

(87) PCT Pub. No.: WO2020/237281

PCT Pub. Date: Dec. 3, 2020

(65) Prior Publication Data

US 2022/0235934 A1 Jul. 28, 2022

(30) Foreign Application Priority Data

May 28, 2019 (AU) ..... 2019901832

(51) Int. Cl.
*F23N 5/18* (2006.01)
*F24C 3/12* (2006.01)

(52) U.S. Cl.
CPC ..... *F23N 5/184* (2013.01); *F24C 3/126* (2013.01); *F23N 2229/00* (2020.01); *F23N 2235/16* (2020.01)

(58) Field of Classification Search
CPC .. F23N 5/184; F23N 2235/16; F23N 2229/00; F24C 3/126

(Continued)

(56) References Cited

U.S. PATENT DOCUMENTS 5,405,263 A * 4/1995 Gerdes ..... F24C 3/085 126/39 K
6,287,108 B1 * 9/2001 Rothenberger ..... F23N 5/184 431/89

(Continued)

FOREIGN PATENT DOCUMENTS

EP 2090827 A2 8/2009
FR 2921461 A1 3/2009

OTHER PUBLICATIONS

Sensiron (Application Note for Sensirion Differential Pressure Sensors (SDP) Mass Flow Temperature Compensation & Sensor Selection Guide. 2017 (Year: 2017).*

*Primary Examiner* — Vivek K Shirsat
(74) *Attorney, Agent, or Firm* — The Webb Law Firm

(57) ABSTRACT

A cooking appliance gas burner system includes a gas burner adapted to receive gas flow from a gas feed line via a venturi. A flow sensor includes a gas flow input in fluid connection with the venturi and configured to measure pressure at the venturi. The flow sensor further includes a differential pressure sensor configured to measure a pressure differential at the venturi between a maximum burner air/gas mixture flow rate and a user input burner air/gas mixture flow rate that is input by a user as a requested percentage of the maximum burner air/gas mixture flow rate. A proportional valve is configured to modulate the air/gas mixture flow rate into the gas burner. A controller is configured to read burner air/gas mixture flow rates from the flow sensor and regulate the burner air/gas mixture flow rate via the proportional valve based upon a user-defined input.

13 Claims, 1 Drawing Sheet

(58) Field of Classification Search
USPC ..... 126/39 R, 39 E
See application file for complete search history.

(56) References Cited

U.S. PATENT DOCUMENTS

| | | | | |
|---|---|---|---|---|
| 8,469,019 | B2 | 6/2013 | Barritt et al. | |
| 8,635,997 | B2 | 1/2014 | Schultz et al. | |
| 8,882,494 | B2 * | 11/2014 | Pickering | F24C 3/126 126/39 BA |
| 8,926,318 | B2 | 1/2015 | Barritt et al. | |
| 2015/0159881 | A1 * | 6/2015 | Cadima | F24C 3/126 431/74 |

* cited by examiner

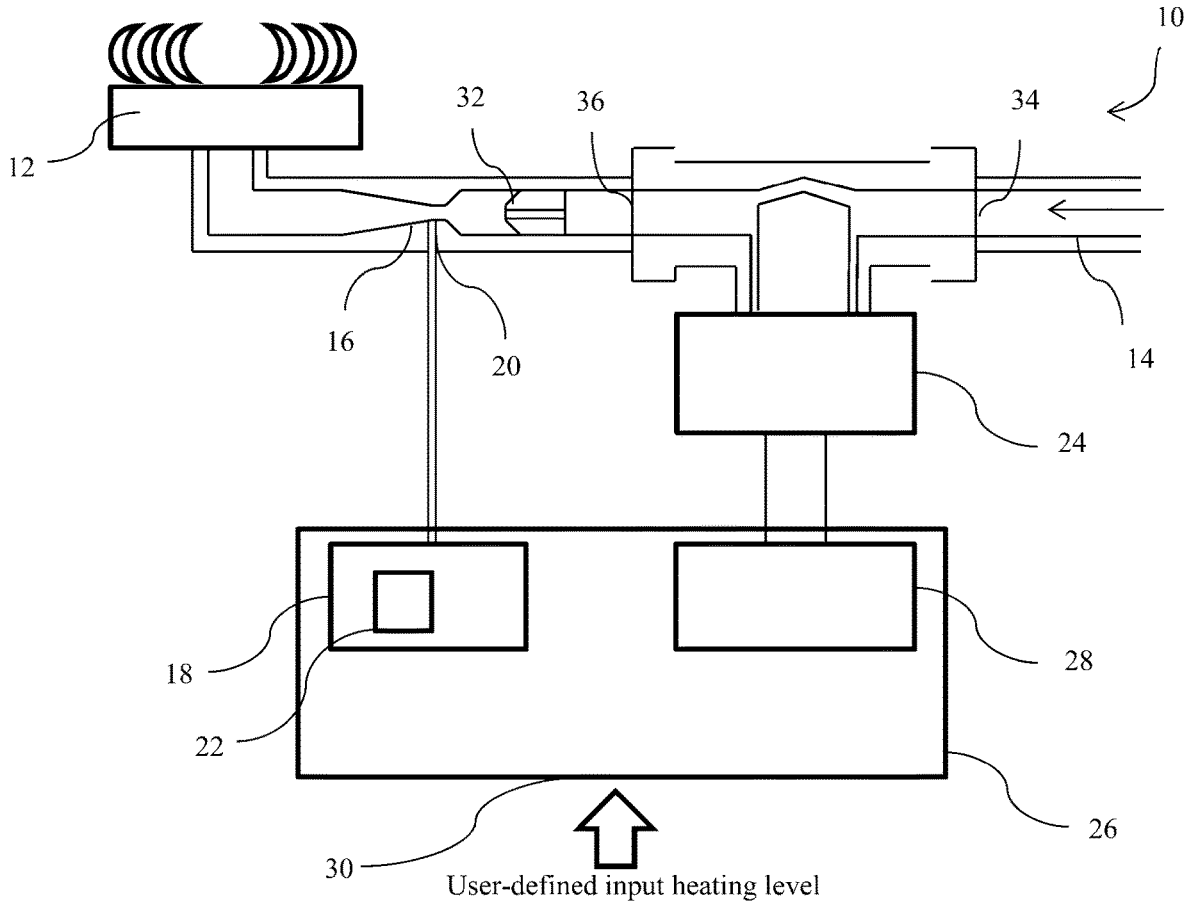
10
12
32
36
34
16
20
14
24
18
22
28
26
30
User-defined input heating level

GAS BURNER FOR COOKING APPLIANCES

CROSS-REFERENCE TO RELATED APPLICATIONS

This application is the United States national phase of International Application No. PCT/AU2020/000043 filed May 27, 2020, and claims priority to Australian Provisional Patent Application No. 2019901832 filed May 28, 2019, the disclosures of which are hereby incorporated by reference in their entirety.

BACKGROUND OF THE INVENTION

Field of the Invention

The present disclosure relates to gas burners for cooking appliances.

Description of Related Art

Gas cooking appliances generally have one or more burners in which gas is mixed with air and burned. In turn, the appliance (and hence the burner(s)) are connected to a gas supply such as a municipal gas supply network. In traditional gas cooking appliances the amount of gas supplied to the burner is regulated using a mechanical gas cock positioned between the gas supply and the burner. The gas cock is operated by a user who sets the gas cock at a desired level to obtain a desired flame height or heat output at the burner.

In use, it is difficult for users to accurately control the heat output of gas burners in gas cooking appliances using traditional gas cocks. One reason for this is the pressure of the gas supplied to the burner can vary over time. Accordingly, it would be desirable for a gas cooking appliance that allows a user to maintain control of the burner power output over time irrespective of fluctuations in gas pressures, temperatures, etc.

Gas cooking appliances that use electronic control systems to regulate the heat output of one or more burners in the cooking appliance have been proposed in the prior art. For example, U.S. Pat. No. 8,926,318 (Barritt, et al.) discloses a gas cooking appliance that has a pressure sensor operable to measure the pressure of gas supplied to a gas burner and generate an electrical output signal and an electronic controller electrically coupled to both the gas burner and the pressure sensor. The controller compares a measured gas pressure with a target pressure, and operates a gas valve to adjust the supply of gas to the gas burner based on the difference between the measured pressure and the target pressure.

There is a need for improved gas burner systems for gas cooking appliances that overcome one or more of the problems associated with the use of existing gas burner systems and/or provide a useful alternative to existing gas burner systems.

SUMMARY OF THE INVENTION

In a first aspect, there is provided a cooking appliance gas burner system comprising:

- a gas burner adapted to receive gas flow from a gas feed line via a venturi;
- a flow sensor comprising a gas flow input in fluid connection with the venturi and configured to measure pressure at the venturi, the flow sensor further comprising a differential pressure sensor configured to measure a pressure differential at the venturi between a maximum burner air/gas mixture flow rate and a user input burner air/gas mixture flow rate that is input by a user as a requested percentage of the maximum burner air/gas mixture flow rate;
- a proportional valve configured to modulate the air/gas mixture flow rate into the gas burner; and
- a controller configured to determine burner air/gas mixture flow rates from the flow sensor and regulate the burner air/gas mixture flow rate via the proportional valve based upon a user-defined input.

In a second aspect, there is provided a method of operating a cooking appliance, comprising:

- receiving a user-defined input signal corresponding to a desired quantity of heat to be delivered by a gas burner to a cooking surface;
- determining a maximum burner air/gas mixture flow rate; and
- modulating the burner air/gas mixture flow rate to provide a target burner air/gas mixture flow rate based upon the user-defined input signal and the determined maximum burner air/gas mixture flow rate.

In a third aspect, there is provided a cooking appliance comprising the gas burner of the first aspect.

BRIEF DESCRIPTION OF THE DRAWING

Embodiments of the present invention will be discussed with reference to the accompanying FIGURE wherein:

FIG. 1 is a schematic of a cooking appliance gas burner according to embodiments of the present disclosure.

In the following description, like reference characters designate like or corresponding parts throughout the figures.

DESCRIPTION OF THE INVENTION

Referring now to FIG. 1, there is shown a cooking appliance gas burner system 10. The gas burner system 10 comprises a gas burner 12 adapted to receive gas flow from a gas feed line 14 via a venturi 16. The cooking appliance gas burner system 10 is suitable for use in gas cooking appliances to provide a variable burner rate to achieve a desired level of heating of a cooking surface.

The gas burner 12 can be any type of atmospheric natural gas or LPG burner that employs a venturi 16 method of inducing air flow into a burner. A wide range of gas burners 12 are commercially available and can be used for this purpose. Advantageously, the cooking appliance gas burner system 10 and methods disclosed herein can be used with any size gas burner 12.

The gas burner 12 comprises an orifice and venturi 16 for the entrainment of air by mixing air with the gas required to generate the burner 12 power output. The gas is extracted from gas feed line 14 which, in turn, is connected to a gas supply network or similar. The gas is supplied at a pressure of the gas supply source and, as will be appreciated, this can fluctuate over time. The gas passes through a gas jet 32 and into the venturi 16 where it is mixed with air which then provides the primary aeration of the gas burner 12.

A flow sensor 18 comprises a gas flow input 20 in fluid connection with the venturi 16 and is configured to measure the pressure at the venturi 16 which, in turn, can be used to determine the rate of flow of a combined air/gas mixture in the burner 12. Specifically, the flow sensor 18 comprises a differential pressure sensor 22 which is configured to measure a pressure differential at the venturi 16 between a maximum burner 12 air/gas mixture flow rate and a user input burner 12 air/gas mixture flow rate. The user input burner air/gas mixture flow rate is input by a user as a requested percentage of the maximum burner 12 air/gas mixture flow rate.

It will be appreciated that the differential pressure sensor 22 does not measure the pressure of the gas in the gas feed line 14 or elsewhere in the cooking appliance gas burner system 10. Instead, the differential pressure sensor 22 measures the pressure at the venturi 16. As the gas passes through the venturi 16, it speeds up inducing the air flow but also creating a low pressure that is proportional to the air/gas mixture flow rate. The differential pressure sensor 22 and the flow sensor 18 therefore measure flow indirectly by measuring the pressure differential across the venturi 16. As used herein the term "determining the gas flow rate" or similar terms means that the gas flow rate is determined based on some other measured parameter, such as pressure, and that value is then used to determine a flow rate.

In use, the flow sensor 18 determines the rate of flow of the combined air/gas mixture in the burner 12 based on a measured pressure at the venturi 16. This positioning of the gas flow input 20 not only allows flow rates to be determined but also means that only air passes through the flow sensor 18, obviating the need for a sensor rated for use with combustible gases. The pressure differential reading is also temperature compensated to provide a true measure of flow rate.

A range of differential pressure sensors 22 can be used in the gas flow sensor 18. Differential pressure sensors 22 are commercially available and can be used for this purpose. For example, a commercially available digital differential pressure sensor 22, range −125 to +125 Pa, can be used.

A proportional valve 24 is operable to control the supply of gas to the gas burner 12. The proportional valve 24 is configured to modulate the air/gas mixture flow rate into the gas burner 12 in accordance with a voltage applied to it by a valve drive 28. The proportional valve 24 includes an actuating device that moves a valve member between a closed valve position and a plurality of open valve positions. A range of gas proportional valves 24 are commercially available and can be used for this purpose, such as a −24V dc, 2 PSI, 0.2 cu m/hr gas proportional valve.

The gas feed line 14 is coupled to the proportional valve 24 at an inlet port 34. An outlet port 36 of the proportional valve 24 is coupled to the gas burner 12 via the jet 32 and venturi 16 assemblies. As the valve member of the proportional valve 24 is opened, the amount of gas advanced through the proportional valve 24 increases proportionately. Although not shown in the figures, it is contemplated that a single gas burner 12 may have more than one proportional valve 24.

In use, a maximum air/gas flow rate is determined by setting the proportional valve 24 to maximum voltage (i.e. fully open). This measurement provides a baseline from which lower flow rate/heat settings are calculated. For example, if the maximum air/gas flow rate is 1000 then a user can regulate to 200 for a gas burner 12 setting of 2 (or 20% of maximum).

A controller 26 is operably connected to the flow sensor 18, the valve drive 28 and a user input interface 30. The controller 26 is configured to receive electrical signals sent by the flow sensor 18 (and any other sensors), the user input interface 30, and a flame sensor (if present). The controller 26 is also configured to activate electronically controlled components of the cooking appliance gas burner system 10 including the proportional valve 24 (e.g. via the valve drive 28) and/or an ignition device (if present).

The controller 26 includes a number of electronic components commonly associated with electronic units utilised in the control of electromechanical systems. For example, the controller 26 may include a processor and a memory device. The memory device can be used to store instructions in the form of, for example, a software routine (or routines) which, when executed by the processor, allows the controller 26 to control operation of the cooking appliance gas burner system 10.

The user input interface 30 can be any form and may, for example, comprise an LED display, an on button, an off button, and up and down controller buttons to allow a user to input a desired heating level. The desired heating level may be a percentage of the maximum heating level (and hence the maximum gas flow rate) and may, for example, be 1%, 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49%, 50%, 51%, 52%, 53%, 54%, 55%, 56%, 57%, 58%, 59%, 60%, 61%, 62%, 63%, 64%, 65%, 66%, 67%, 68%, 69%, 70%, 71%, 72%, 73%, 74%, 75%, 76%, 77%, 78%, 79%, 80%, 81%, 82%, 83%, 84%, 85%, 86%, 87%, 88%, 89%, 90%, 91%, 92%, 93%, 94%, 95%, 96%, 97%, 98%, 99% or 100% of the maximum flow rate. The controller 26 is configured to read gas burner 12 air/gas mixture flow rates from the flow sensor 18 and regulate the gas burner 12 air/gas mixture flow rate based upon the user-defined input via the proportional valve 24 and the valve drive 28. The controller 26 is also operable to generate a control signal indicative of the maximum air/gas mixture flow rate.

The cooking appliance gas burner system 10 may have an ignition device (not shown) that is operable to ignite gas exiting from the gas burner 12 and produce a controlled flame in response to control signals received from the controller 26.

Optionally, the cooking appliance gas burner system 10 may have a flame sensor positioned adjacent to the gas burner 12 to sense or detect whether a flame is produced in the gas burner 12. The flame sensor may be operably connected to the controller 26 which, in turn, may operate the valve drive 28 to close the proportional valve 24 if no flame is detected at the gas burner 12.

The cooking appliance gas burner system 10 disclosed herein provides a novel means of electronically regulating the flow of the gas/air mixture to a gas burner 12. The system obviates the need for a gas cock allowing full electronic control of the gas burner 12 heating level Unlike other known systems, the cooking appliance gas burner system 10 disclosed herein measures the flow of the air/gas mixture into the burner 12 and uses this information to regulate the burner 12 heating level.

In use, heating is initiated when the user sets a non-zero heating level using the controller 26. The heating level is converted into a percentage of the maximum gas burner 12 output. The controller 26 initially sets the proportional valve 24 level to maximum and measures the flow rate of the air/gas mixture. The resulting flow measurement determines the maximum flow level for the gas burner 12. The controller 26 then adjusts the valve drive 28 to achieve the requested percentage of the maximum flow based on continuous flow measurements.

The cooking appliance gas burner system 10 differs from existing systems in the following ways:

The burner 12 heat rate is accurately controlled by measuring the air/gas flow rate at the gas burner 12 and using this as the basis for regulating the flow rather than just the gas flow or gas line 14 pressure;

The gas flow rate can be varied using a low cost, simple proportional valve 24 rather than an electromechanical gas cock or precision proportional valve;

The air/gas flow rate is measured giving a much better indication of gas burner 12 output level;

The flow rate measurement is not dependent on gas line 14 pressure and is compensated for temperature;

Flow is measured at the venturi 16 of the gas burner 12 at a low pressure point. This means that only cool air is passing through the flow sensor 18;

The cooking appliance gas burner system 10 can be retro-fitted to existing gas burners 12 requiring only a small hole to be drilled in the venturi 16;

The cooking appliance gas burner system 10 does not require use of a sensor that is safe to use with flammable materials; and The cooking appliance gas burner system 10 is self-calibrating.

Also disclosed herein is a method of operating a cooking appliance. The method comprises receiving a user-defined input signal corresponding to a desired quantity of heat to be delivered by a gas burner to a cooking surface; determining a maximum burner air/gas mixture flow rate; and modulating the burner air/gas mixture flow rate to provide a target burner air/gas mixture flow rate based upon the user-defined input signal and the determined maximum burner air/gas mixture flow rate.

Also provided herein is a cooking appliance comprising the gas burner system.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement of any form of suggestion that such prior art forms part of the common general knowledge.

It will be appreciated by those skilled in the art that the invention is not restricted in its use to the particular application described. Neither is the present invention restricted in its preferred embodiment with regard to the particular elements and/or features described or depicted herein. It will be appreciated that the invention is not limited to the embodiment or embodiments disclosed, but is capable of numerous rearrangements, modifications and substitutions without departing from the scope of the invention as set forth and defined by the following claims.

The invention claimed is:

1. A cooking appliance gas burner system comprising:

a gas burner adapted to receive gas flow from a gas feed line via a venturi configured to mix air with the gas flow to provide the primary acration of the gas burner;

a flow sensor comprising a gas flow input in fluid connection with the venturi and configured to measure pressure at the venturi, the flow sensor further comprising a differential pressure sensor configured to measure a pressure differential at the venturi between a maximum burner air/gas mixture flow rate and a user input burner air/gas mixture flow rate that is input by a user as a requested percentage of the maximum burner air/gas mixture flow rate;

a proportional valve configured to modulate the air/gas mixture flow rate into the gas burner; and a controller configured to read burner air/gas mixture flow rates from the flow sensor and regulate the burner air/gas mixture flow rate via the proportional valve based upon a user-defined input.

2. The cooking appliance gas burner system of claim 1, wherein the measured pressure differential is temperature compensated.

3. The cooking appliance gas burner system of claim 1, wherein the differential pressure sensor has a range −125 Pa to +125 Pa.

4. The cooking appliance gas burner system of claim 1, wherein the proportional valve is configured to modulate the air/gas mixture flow rate into the gas burner in accordance with a voltage applied to it by a valve drive.

5. The cooking appliance gas burner system of claim 1, wherein the proportional valve is a −24V dc, 2PSI, 0.2 cu m/hr gas proportional valve.

6. The cooking appliance gas burner system of claim 1, comprising more than one proportional valve.

7. The cooking appliance gas burner system of claim 1, wherein the controller is configured to activate electronically controlled components of the cooking appliance gas burner system including the proportional valve and an ignition device.

8. The cooking appliance gas burner system of claim 1, wherein the controller is operable to generate a control signal indicative of the maximum air/gas mixture flow rate.

9. The cooking appliance gas burner system of claim 1, further comprising an ignition device that is operable to ignite gas exiting from the gas burner and produce a controlled flame in response to control signals received from the controller.

10. The cooking appliance gas burner system of claim 1, further comprising a flame sensor positioned adjacent to the gas burner to sense or detect whether a flame is produced in the gas burner.

11. The cooking appliance gas burner system of claim 10, wherein the flame sensor is operably connected to the controller which, in turn, operates the valve drive to close the proportional valve if no flame is detected at the gas burner.

12. A method of operating a cooking appliance, comprising:

receiving a user-defined input signal corresponding to a desired quantity of heat to be delivered by a gas burner to a cooking surface;

determining a maximum burner air/gas mixture flow rate using a flow sensor comprising a gas flow input in fluid connection with a venturi which is configured to mix air with the gas flow to provide a primary aeration of the gas burner, the flow sensor being configured to measure pressure at the venturi, the flow sensor further comprising a differential pressure sensor configured to measure a pressure differential at the venturi between the maximum burner air/gas mixture flow rate and a user input burner air/gas mixture flow rate that is input by a user as a requested percentage of the maximum burner air/gas mixture flow rate; and modulating the burner air/gas mixture flow rate to provide a target burner air/gas mixture flow rate based upon the user-defined input signal and the determined maximum burner air/gas mixture flow rate.

13. A cooking appliance comprising the gas burner of claim 1.

* * * * *